United States Patent [19]

Arnold

[11] 4,090,356

[45] May 23, 1978

[54] GRAVITY READING PACER

[76] Inventor: Patrick Raymond Arnold, 6668 Donecote Dr., Columbia, Md. 21044

[21] Appl. No.: 664,146

[22] Filed: Mar. 5, 1976

[51] Int. Cl.[2] ..... G04F 1/08

[52] U.S. Cl. ..... 58/144; 35/35 B

[58] Field of Search ..... 58/4 M, 144; 35/35 B; 92/9

[56] References Cited

U.S. PATENT DOCUMENTS

| | | | |
|---|---|---|---|
| 2,714,927 | 8/1955 | Stern et al. | 58/144 |
| 2,984,064 | 5/1961 | Russell et al. | 58/144 |
| 3,025,665 | 3/1962 | Dock et al. | 58/144 |
| 3,938,315 | 2/1976 | Von Kemenczkt | 58/144 |

*Primary Examiner*—Robert K. Schaefer
*Assistant Examiner*—Vit W. Miska

[57] ABSTRACT

A reading pacer and reading speed indicator including a transparent tube having a viscous fluid therein and a pace-indicating member of differing density from that of the fluid, such as a steel ball, for association with the lateral edge of reading matter in order to be visible in the peripheral vision of a reader and to pace or indicate a reading rate in accordance with the slope or angle thereof with respect to the vertical. A curved section of the tube carries both indicia and an indicator member for preselecting or determining the slope of the pacer tube.

Preferably, the pacer unit includes means for attaching or mounting the unit directly upon the surface of the page and includes means for quickly re-setting the pace-indicating member into association with the first portion of the reading matter. The pacer unit may be invertible for reset or may include mobile means such as a magnet for re-setting a ferrous pace-indicating member.

10 Claims, 4 Drawing Figures

FIG. 3
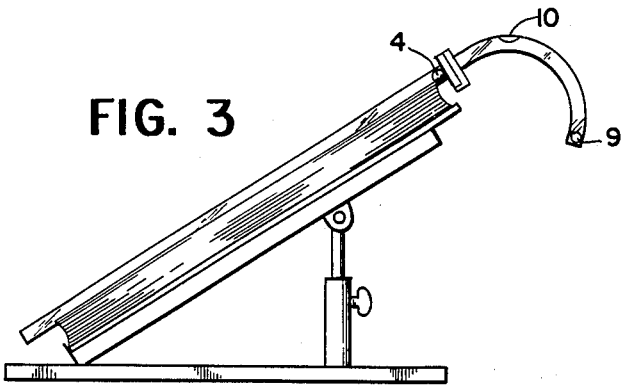
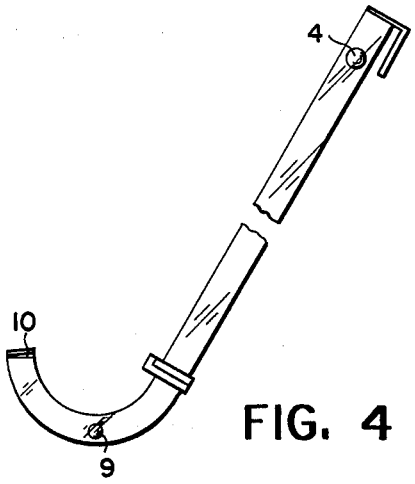
FIG. 4
FIG. 1
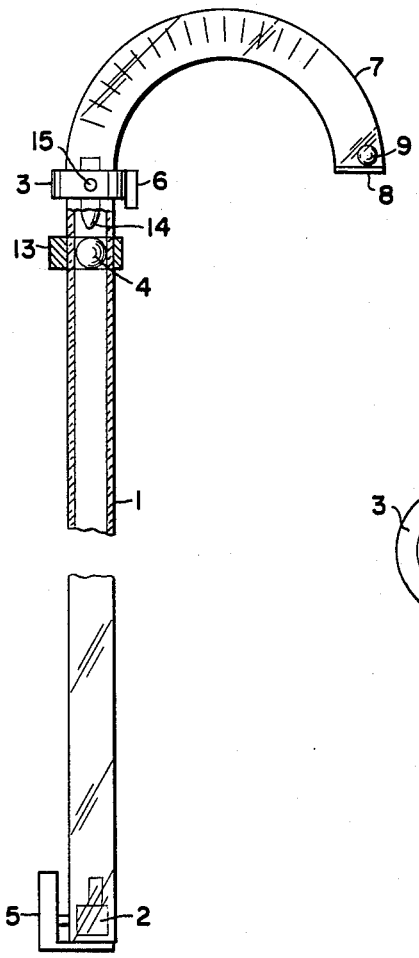
FIG. 2
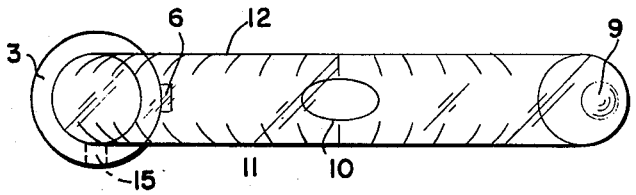

GRAVITY READING PACER

BACKGROUND OF THE INVENTION

The present invention relates to pacers and indicators for reading, and is concerned, more particularly, with a gauge for indicating a rate of reading within the peripheral vision of the reader immediately adjacent to the lateral edge of the subject matter to be read.

SUMMARY OF THE INVENTION

In general, the preferred form of the present invention comprises a transparent tube enclosing a viscous fluid and a pace-indicating member of differing density, and a calibrated, slope-indicating member associated with the tube.

BRIEF DISCUSSION OF THE PRIOR ART

A variety of attempts have been made either to pace the reading rate of individuals or to evaluate or measure their comfortable or habitual reading rates.

These have included stopwatch-timing of measured-length reading matter, moveable gates which progress over the reading matter at a predetermined rate, audible alarms and similar, comparatively complex or sophisticated installations.

However, these prior approaches have been in the nature of schoolrooms or laboratory installations for testing students or for remedial or speed-reading classes.

The dictatorial approach of gate or aperture pacers, automatic or timed page-turning or page-changing, whether by display-change or by required page-turning as dictated by an alarm, are unfortunate in their tendency to provoke an emotional, hurry-up or panic response which detracts from the individual's concentration and comprehension of the subject matter being read and, therefore, detracts from the purpose of the excercise or the accuracy and validity of the testing. Many of these systems make it impossible for a reader to revert or re-scan a portion of the reading matter to ensure clear comprehension of critical passages.

An important area in which prior reading-pacers have been quite deficient is that of self-practice at home or otherwise at the relaxed convenience of individuals. Accurate and variable self-timers are not only expensive but also are most inconvenient to use in many circumstances such as in a commuting or other travel environment.

Alarm clocks or other signal-type timing units may be used, but provide no continuing or progressive indication of the progress of the exercise.

Timers such as sand-glass or analogous gravity-timers may show a progress or rate, when they are repeatedly observed, but the distraction resulting from or occasioned by such observance or checking interrupts the reading exercise and, consequently, defeats the purpose of the whole procedure.

The following prior patents were encountered during a patentability investigation regarding the present invention:

U.S. Pat. No. 2,925,670
U.S. Pat. No. 2,984,916
U.S. Pat. No. 3,025,665
U.S. Pat. No. 3,111,004
U.S. Pat. No. 3,128,344
U.S. Pat. No. 3,166,839
U.S. Pat. No. 3,240,007

U.S. Pat. No. 3,458,990
U.S. Pat. No. 3,488,811 and
U.S. Pat. No. 3,553,959

However, the means heretofore available for pacing or checking upon reading speed have not been found to be entirely satisfactory, particularly with regard to their deficiencies for personal use apart from classrooms and laboratories.

BRIEF DESCRIPTION OF THE DRAWAGE

These and other objects of the invention and a better understanding thereof may be derived from the following description and the accompanying drawings in which FIG. 1 is a side view of the preferred form of reading pacer according to the invention;

FIG. 2 is a plan view of the pacer of FIG. 1;

FIG. 3 is a view similar to FIG. 1, on a reduced scale, showing the pacer mounted on a stand-supported book in a first use position, and FIG. 4 is a view similar to FIG. 3 and showing the pacer mounted on a book in an alternate use position.

DETAILED DESCRIPTION OF THE PREFERRED EMBODIMENT

As shown in the drawings, the preferred form of pacer of the present invention comprises a transparent, hollow tube 1 which is closed via a suitable plug 2 at a first end and by a flange 3 at its opposite end. The tube 1 contains a viscous fluid therein and a loose, pace-indicating member 4.

The plug 2 and flange 3, preferably carry clips 5 and 6, respectively, for mounting the pacer in the opposite or inverted positions shown in FIGS. 3 and 4.

The flange 3 also has secured thereto a transparent, U-shaped tube 7 having one end closed by the flange 3 and its opposite end closed by a plug 8. The U-tube 7 contains a relatively thin or low-viscosity fluid, such as alchohol, water, or a mix, a small ball 9 of more dense material and a small gas, light fluid or air bubble 10 similar to that of a spirit level.

Preferably, the end of the U-tube 7 is co-axial with, or at least parallel to, the axis of the tube 1.

The intermediate portion of the U-tube is provided with indicia or calibration marks 11 which provide a gauge, in conjunction with the slope indicating ball 9 and bubble 10, whereby the slope of the tube 1 may be fixed or determined.

The calibration or positioning of the indicia is to be correlated to the rate of descent of the pace-indicating member 4, through the viscous fluid, as determined by the slope of the tube. This will indicate a rate of travel in, for example, inches per minute, which may be correlated to the average number of words per page-inch of the typeface of the book or other reading matter.

In a preferred form for use with paperbacks, however, I prefer also to calibrate the U-tube 7 in units of word per minute in accordance with a standard typeface or a typeface which is standard for a given type or series of books or the books of a selected publisher. Accordingly, the U-tube 7 may be calibrated either in units of distance per unit time or average words per unit time, or both, as in the preferred form shown including a second scale 12.

It is apparent that the rate of descent of the pace-indicating member 4 is dependent upon several controllable variables, including the viscosity of the liquid, the density of the member 4 and the size of the member 4 in relation to the inside diameter of the tube, in addition to the slope at which the pacer is employed.

One suitable form of the invention incorporated a viscous liquid comprising a mixture of propylene glycol and simple syrup, a 3/16 inch ID tube and a ⅛ inch steel ball. The steel ball 4 may be made of any other magnetic material. This pacer provides rates of descent appropriate for the reading of paperbacks within a comfortable range of book-angles for convenient reading.

A convenient form of quick-reset for the pace-indicating member 4 includes a ring magnet 13 surrounding and slideable along the tube 1. An abutment pin 14 adjacent the flange 3 limits the travel of the steel-ball member 4 with the magnet 13, so that continued motion of the magnet upwardly beyond the abutment 14 will release the ball 4 whenever reading is to start. Preferably, the flange 3 includes at least a portion of magnetic material, such as an insert 15, so that the magnet itself may be "parked" against the flange until it is needed to reset the ball 4.

When the pacer includes both a magnet for resetting the unit and a clip 5, it is preferable to include an abutment 16 to stop the ball sufficiently far from the clip 5 to allow the magnet clearance to surround and pick up the ball within its field for quick elevation to the top of the unit and of the reading matter.

In operation, the pacer is mounted against the face of a book alongside the printed matter and within the peripheral-vision range. Most conveniently, this position will be in the hinge area of the book, so that the pacer is visible in the peripheral-vision range of both the left and right pages.

When reading of the left-hand page has been completed, the pace-indicating ball 4 may be reset by drawing the magnet down and then raising it to park against the flange 3. The ball is thus quickly recycled or reset to the upper portion of the pacer, and resumes its descent when the magnet passes upward beyond the abutment 14.

When reading of the right-hand page is completed or whenever desired, the especially advantageous slope indicator tube 7 may be employed in alternate positions, as best shown in FIGS. 3 and 4.

In the position shown in FIG. 3, the bubble 10 indicates the slope of the pacer unit, mounted on the book by means of the clip 6. It is to be understood that the book may be positioned on a stand, as shown, or may be simply propped at the suitable angle.

When a page is finished or is to be turned, the entire pacer is simply inverted, as shown in FIG. 4, and mounted on the book by means of the clip 5. The ball 9 then becomes the slope indicator, in the lower position of the U-tube, while the pace-indicating ball member 4 is thereby automatically reset for pacing the next page of reading matter.

If desired, the quick-reset magnet may be dispensed with in favor of the inversion of the pacer. However, the magnet reset is quite convenient for use between adjacent pages, while the inversion of the pacer is most convenient in conjunction with the turning of pages.

Therefore, it is apparent that the present invention provides an extremely advantageous reading pacer which does not require diversion of the reader's attention and which is simple and reliable in construction and in use.

Various changes may be made in the details of the invention, as disclosed, without sacrificing the advantages thereof or departing from the scope of the appended claims.

What is claimed is:

1. A reading pacer comprising a. an elongated hollow tube, said tube being at least in part transparent along a portion of its length, b. a pair of closed portions longitudinally-spaced from each other in said tube, c. a viscous fluid substantially completely filling the volume of said tube intermediate said longitudinally-spaced closed portions, d. a pace indicating member within said viscous fluid, said pace-indicating member having a density different from that of the viscous fluid causing movement of the member through the fluid at varying rates that are controlled by the angle of the tube as it relates to the horizontal, e. means for positioning said tube along a lateral margin of the reading matter, on a surface whereby movement of the pace-indicating member operates in the reader's peripheral vision, providing continuous pacing (as opposed to timing) of the reading process, and f. a curved angle indicating means on one end of the pacer tube carrying indicia correlated to the slope of the straight portion of the reading pacer tube, a fluid in said curved portion of the reading pacer tube, and a slope indicating member moveable along said indicia.

2. The pacer of claim 1 in which said slope indicating member is more dense than the fluid in said portion of curved tube.

3. The pacer of claim 1 in which said slope indicating member is less dense than the fluid in said portion of curved tube.

4. The pacer of claim 1 including a magnet for resetting the pace indicating member.

5. The reading pacer of claim 1 including rate-varying means for changing the rate of progress of the pace-indicating member along the margin of the reading material, so the pace indicating member will pace more rapidly along the margin of the reading material when the tube and reading material are held at a higher angle; and will pace more slowly if the tube and reading material are held at a lesser angle.

6. The reading pacer of claim 2 in which the rate-varying means provides for changing the slope of the pacer tube to a predetermined value that will correlate to a desired reading rate.

7. The reading pacer of claim 3 including means for mounting pacer tube substantially flush with the surface bearing the reading matter.

8. A reading pacer of claim 4 including indicating means for showing variations in the slope of the pacer tube.

9. A reading pacer comprising a. an elongated hollow tube, said tube being at least in part transparent along a portion of its length, b. a pair of closed portions longitudinally-spaced from each other in said tube, c. a viscous fluid substantially completely filling the volume of said tube intermediate said longitudinally-spaced closed portions, d. a pace-indicating member within said viscous fluid, said pace-indicating member having a density different from that of the viscous fluid causing movement of the member through the fluid at varying rates that are controlled by the angle of the tube as it relates to the horizontal, e. means for positioning said tube along a lateral margin adjacent of the reading matter, on a surface whereby movement of the pace-indicating member operates in the reader's peripheral vision, providing continuous pacing (as opposed to timing) of the reading process, and f. a magnet for resetting the pace-indicating member, said magnet being mounted on said elongated tube for reciprocation therealong, and g. abutment means in said tube for defining a limit of travel of said pace-indicating member in response to said magnet.

10. The pacer of claim 9 including means for holding said magnet in a storage position beyond the limit of travel of said pace-indicating member in response to said magnet.

* * * * *